US005907951A

United States Patent [19]

Toyooka et al.

[11] Patent Number: 5,907,951

[45] Date of Patent: Jun. 1, 1999

[54] HYDRAULIC CONTROL SYSTEM FOR CONSTRUCTION MACHINE

[75] Inventors: Tsukasa Toyooka; Toichi Hirata; Genroku Sugiyama; Kouji Ishikawa; Tsuyoshi Nakamura, all of Ibaraki-ken, Japan

[73] Assignee: Hitachi Construction Machinery Co., Ltd., Tokyo, Japan

[21] Appl. No.: 09/035,334

[22] Filed: Mar. 5, 1998

[30] Foreign Application Priority Data

Mar. 7, 1997 [JP] Japan ..... 9-053262

[51] Int. Cl.[6] ..... F04B 1/26; F16D 31/02

[52] U.S. Cl. ..... 60/445; 60/444

[58] Field of Search ..... 60/427, 444, 445, 60/446, 465

[56] References Cited

U.S. PATENT DOCUMENTS 3,871,178 3/1975 Tominaga ..... 60/445 X 4,196,588 4/1980 Johnson ..... 60/445

4,481,770 11/1984 Lohbauer et al. ..... 60/445 X 4,712,377 12/1987 Yoshida et al. ..... 60/445 X

*Primary Examiner*—John E. Ryznic

*Attorney, Agent, or Firm*—Evenson, McKeown, Edwards & Lenahan, P.L.L.C.

[57] ABSTRACT

A hydraulic control system according to the present invention for a construction machine is provided with a directional control valve switchable by a pilot control valve, a hydraulic cylinder, a pilot pump, a selector valve for selecting one of a maximum value out of pilot pressures of the pilot control valve, a flow control unit for controlling the flow rate of a variable displacement hydraulic pump, a pressure-reducing valve for converting a delivery pressure of the pilot pump to a pump control signal, which controls driving of the flow control unit, in accordance with a pilot pressure guided to a first signal line connected to the selector valve, a branch line connecting the pilot pump and the pressure-reducing valve with each other, and a second signal line for guiding the pump control signal, which has been converted at the pressure-reducing valve, to the flow control unit.

7 Claims, 5 Drawing Sheets

HYDRAULIC CONTROL SYSTEM FOR CONSTRUCTION MACHINE

BACKGROUND OF THE INVENTION a) Field of the Invention

This invention relates to a hydraulic control system for a construction machine such as a hydraulic excavator, and especially to a hydraulic control system for controlling a delivery rate of a variable displacement hydraulic pump by a positive control method.

b) Description of the Related Art

As a conventional hydraulic control system for an actuator arranged in a construction machine, a positive control system that controls a delivery rate of a pump by a pilot pressure outputted from a pilot control valve is known to the public.

FIG. 7 is a hydraulic circuit diagram illustrating a conventional hydraulic control system of such a positive control type for a construction machine, FIG. 8 is a diagram showing output characteristics of a pilot control valve disposed in the hydraulic control system depicted in FIG. 7, and FIG. 9 is a diagram showing delivery rate characteristics of a variable displacement hydraulic pump arranged in the hydraulic control system depicted in FIG. 7.

The conventional hydraulic control system shown in FIG. 7 is provided with a variable displacement hydraulic pump 1 making up a main pump, an actuator driven by pressure fluid delivered from the variable displacement hydraulic pump 1, for example, a hydraulic cylinder 4, and a directional control valve 3 for controlling a flow of the pressure fluid to be fed from the variable displacement hydraulic pump 1 to the hydraulic cylinder 4. When the directional control valve 3 is switched to a position 3*a*, the hydraulic cylinder 4 is brought, at a bottom side thereof, into communication with the variable displacement hydraulic pump 1 and is also brought, at a rod side thereof into communication with a tank 9. When the directional control valve 3 is switched to a position 3*b*, on the other hand, the hydraulic cylinder 4 is brought, at the rod side thereof, into communication with the variable displacement hydraulic pump 1 and is also brought, at the bottom side thereof, into communication with the tank 9. The delivery rate of the variable displacement hydraulic pump 1 is controlled by a flow control unit 2. The hydraulic cylinder 4 drives a working equipment of a work vehicle which is not illustrated. If the work vehicle is a hydraulic excavator, for example, the hydraulic cylinder 4 can be an arm cylinder, a boom cylinder or the like.

The conventional hydraulic control system shown in FIG. 7 is also equipped with a pilot control valve 5 for outputting a pilot pressure Pa adapted to switch the directional control valve 3, a pilot pump 7 for feeding pressure fluid to the pilot control valve 5, and a pilot relief valve 8 for specifying the delivery pressure of the pilot pump 7. The pilot control valve 5 is composed of pressure-reducing valve portions 10, 11 and a control lever 5*a* for operating these pressure-reducing valve portions 10, 11. The pressure-reducing valve portion 10 is connected to one of drive control units of the directional control valve 3 via a pilot line 13, whereas the pressure-reducing valve portion 11 is connected to the other drive control unit of the directional control valve 3 via a pilot line 14. The conventional hydraulic control system is also equipped with a selector valve 6, which selects one of a greater value out of a pilot pressure Pa in the pilot line 13 and another pilot pressure Pa in the pilot line 14 and outputs the pilot pressure of the greater value as a pump control signal Pc to the flow control unit 2 via a signal line 12.

Output characteristics of the pilot control valve 5, that is, a relationship between a stroke S of the control lever 5*a* and pilot pressures Pa outputted from the pressure-reducing valve portions 10, 11 is set in such a way that, as is illustrated in FIG. 8, each pilot pressure Pa is outputted at a level substantially proportional with the stroke S. Further, delivery rate characteristics of the variable displacement hydraulic pump 1, that is, a relationship between the pump control signal Pc applied to the flow control unit 2 and a pump flow rate Q delivered from the variable displacement hydraulic pump 1 is set in such a way that, as is shown in FIG. 9, the pressure fluid is delivered at a pump flow rate Q which is substantially in proportion with the pump control signal Pc (which is equal to the above-selected pilot pressure Pa).

According to the conventional hydraulic control system constructed as described above, turning of the control lever 5*a* of the pilot control valve 5 over a stroke S in the direction of arrow 5*b*, for example, to make the hydraulic cylinder 4 perform an extending operation actuates the pressure-reducing valve 10, and a pilot pressure Pa is outputted from the pressure-reducing valve portion 10. This pilot pressure Pa is outputted to the one drive control unit of the directional control valve 3 via the pilot line 13 so that the directional control valve 3 is switched to the position 3*a*. At this time, the pilot pressure Pa in the pilot line 13 is selected by the selector valve 6, and this pilot pressure Pa is outputted as a pump control signal Pc to the signal line 12. The flow control unit 2 is driven by the pump control signal Pc, and the pump flow rate Q of the pressure fluid delivered from the variable displacement hydraulic pump 1 is controlled at a level corresponding to the stroke S of the control lever 5*a* of the pilot control valve 5. The pressure fluid delivered at the pump flow rate Q from the variable displacement hydraulic pump 1 is fed to the bottom side of the hydraulic cylinder 4 via the directional control valve 3, and the fluid on the rod side is returned to the tank 9 via the directional control valve 3. As a consequence, the hydraulic cylinder 4 performs an extending operation so that the associated working equipment of the unillustrated work vehicle is driven.

As conventional art of this kind, reference may be had to Japanese Patent No. 2,534,897.

In the above-described conventional hydraulic control system shown in FIG. 7, the pilot pressure Pa of the greater value fed to the selector valve 6 is guided, as is, as the pump control signal Pc to the signal line 12 to drive the flow control unit 2. Due to a design limitation to the layout that the position of a pilot circuit—which includes the pilot control valve 5, the directional control valve 3, the pilot lines 13, 14 and the selector valve 6—and the position of the flow control unit 2—which is arranged in the vicinity of the variable displacement hydraulic pump 1—have to be separated sufficiently from each other, the above-mentioned signal line 12 is generally made of a rubber hose, the length of which is as long as several meters. Accordingly, the total volume of the volume of the signal line 12 and the volumes of the pilot lines 13, 14 connected to the respective drive control units of the directional control valve 3 is relatively large.

In the conventional hydraulic control system shown in FIG. 7, it therefore takes some time after operation of the control lever 5*a* and hence actuation of the pilot control valve 5 until the cumulative quantity of the pilot pressure fluid outputted from the pressure-reducing valve portion 10 or the pressure-reducing valve portion 11 becomes equal to the above-mentioned total volume, although this time is not substantial. As a result, the switching of the directional control valve 3 tends to be delayed. Further, an increase in the flow rate of pressure fluid to the line 13 or 14 and thus to the line 12 results in the occurrence of a greater pressure loss at the selector valve 6, so that the actuation of the flow control unit 2 also tends to become late. In other words, the switching responsibility of the directional control valve 3 to the operation of the pilot control valve 5 tends to be reduced and, moreover, the follow-up controllability of an increase or decrease in the pump flow rate Q of the variable displacement hydraulic pump 1 for the operation of the pilot control valve 5 also tends to be deteriorated. For these, the conventional hydraulic control system is accompanied by problems that the accuracy of driving control of the hydraulic cylinder 4 controlled by the directional control valve 3, that is, of the actuator tends to be lowered and no improvement can thus be expected in the efficiency of work to be performed by the construction machines

SUMMARY OF THE INVENTION

With the foregoing situation of the conventional art in view, the present invention has as an object thereof the provision of a hydraulic control system for a construction machine, which can improve the switching responsibility of a directional control valve to an operation of a pilot control valve and can also improve the follow-up controllability of an increase or decrease in the pump flow rate of a variable displacement hydraulic pump for the operation of the pilot control valve.

To achieve the above-described object, the present invention provides, in one aspect thereof, a hydraulic control system for a construction machine provided with a variable displacement hydraulic pump, an actuator driven by pressure fluid delivered from the variable displacement hydraulic pump, a directional control valve for controlling a flow of the pressure fluid delivered from the variable displacement hydraulic pump and to be fed to the actuator, a pilot control valve capable of outputting plural pilot pressures for switching the directional control valve, a pilot pump for feeding pressure fluid to the pilot control valve, a selector valve for selecting one of a maximum value out of the plural pilot pressures outputted from the pilot control valve, and a flow control unit for controlling a delivery rate of the variable displacement hydraulic pump on a basis of the pilot pressure selected by the selector valve, characterized in that the hydraulic control system comprises: a first signal line for guiding the pilot pressure selected by the selector valve; a pressure control valve for converting a delivery pressure of the pilot pump to a pump control signal, which serves to control driving of the flow control unit, in accordance with the pilot pressure guided through the first signal line; a branch line for connecting the pilot pump and the pressure control valve with each other; and a second signal line for guiding the pump control signal, which has been converted by the pressure control valve, to the flow control unit.

According to the present invention constructed as described above, the pressure control valve can be arranged almost independently from the position of the flow control unit, that is, can be disposed at a position adjacent to the selector valve. As a consequence, the first signal line—which serves to guide a pilot pressure, which has been fed to the selector valve, as a pressure signal for driving the pressure control valve—can be significantly shortened. For example, it can be arranged as a signal line of several tens of centimeters or so in length.

It is therefore possible to set at a relatively small value the total volume of the volume of the first signal line and the volumes of the pilot volumes connected to the respective drive control units of the directional control valve. As a result, when the pilot control valve is operated, the resulting pilot pressure is instantaneously applied to the corresponding drive control unit of the directional control valve, thereby switching the directional control valve. Namely, the directional control valve is switched by a stroke corresponding to the stroke of the pilot control valve, so that the directional control valve exhibits good switch responsibility to the operation of the pilot control valve.

When the pilot control valve is operated, the resulting pilot pressure is guided via the first signal line to operate the pressure control valve. Pressure fluid, which has been outputted from the pilot pump and has been guided via the branch line, is converted to a pump control signal at the pressure control valve. This pump control signal is outputted to the flow control unit through the second signal line. As a result, the flow control unit is driven so that the pump flow rate of the variable displacement hydraulic pump is controlled corresponding to the stroke of the pilot control valve. Pressure fluid delivered from the variable displacement hydraulic pump is fed to the actuator by way of the directional control valve, whereby the actuator is driven corresponding to the stroke of the pilot control valve. Accordingly, a sufficient flow rate can be assured for the pump control signal—which is obtained by converting the flow rate and pressure of the pressure fluid outputted from the pilot pump—irrespective of the volume of the pilot lines which communicate the pilot control valve with the respective drive control units of the directional control valve. As a consequence, when the pressure control valve is driven, the flow control unit is instantaneously driven. For the operation of the pilot control valve, good follow-up controllability of an increase or decrease in the pump flow rate of the variable displacement hydraulic pump can therefore be obtained.

Preferably, the pressure control valve may be a pressure-reducing valve. When the pilot operation is operated, the pressure-reducing valve is operated by the resulting pilot pressure so that the pressure fluid, which has been outputted from the pilot pump and guided via the branch line, is reduced in pressure and converted to a pump control signal at the pressure-reducing valve. This pump control signal is then outputted to the flow control unit via the second signal line.

Here, the pressure-reducing valve can be a pressure-reducing valve for setting the pump control signal at a tank pressure when the pressure-reducing valve is at a center position. In this case, the flow control unit is in communication with the tank via the second signal line, when the pilot control valve is not operated and the pressure-reducing valve remains at the center position. As a result, the flow control unit sets the variable displacement hydraulic pump at a predetermined minimum pump flow rate.

As an alternative, the pressure-reducing valve may be a pressure-reducing valve for setting the pump control signal at a predetermined pressure higher than a tank pressure when the pressure-reducing valve is at a center position. In this case, the predetermined pressure higher than the tank pressure is applied to the flow control unit via the second signal line when the pilot control valve is not operated and the pressure-reducing valve remains at the center position. As a consequence, the flow control unit sets the variable displacement hydraulic pump at a pump flow rate greater than a predetermined minimum flow rate even when the pilot control valve is not operated.

In the above-described hydraulic control system according to the present invention, the pressure control valve may be a relief valve, a restrictor may be arranged in the branch line, and the pump control signal may be outputted from the branch line at a position between the restrictor and the relief valve. In this case, when the pilot control valve is operated, the relief valve is operated by the resulting pilot pressure so that the flow rate and pressure of pressure fluid, which has been outputted from the pilot pump and guided via the branch line, vary in the branch line at the position between the relief valve and the restrictor, which is located upstream of the relief valve, according to a pilot pressure outputted from the pilot control valve. Namely, the pressure fluid outputted from the pilot pump is converted to a pump control signal corresponding to the pilot pressure of the pilot control valve, and this pump control signal is outputted to the flow control unit via the second signal line.

Here, the relief valve may be a relief valve for setting the pump control signal at a tank pressure when the relief valve is at a center position. In this case, when the pilot control valve is not operated and the relief valve remains at the center position, the flow control unit is in communication with the tank via the second signal line so that the flow control unit sets the variable displacement hydraulic pump at a predetermined minimum pump flow rate.

As an alternative, the relief valve may be a relief valve for setting the pump control signal at a predetermined pressure higher than a tank pressure when the relief valve is at a center position. In this case, the predetermined pressure higher than the tank pressure is applied to the flow control unit via the second signal line when the pilot control valve is not operated and the relief valve remains at the center position. As a consequence, the flow control unit sets the variable displacement hydraulic pump at a pump flow rate greater than a predetermined minimum flow rate even when the pilot control valve is not operated.

BRIEF DESCRIPTION OF THE DRAWINGS

The above and other objects, features and advantages of the present invention will become apparent from the following description and the appended claims, taken, in conjunction with the accomanying drawings in which:

DETAILED DESCRIPTION OF THE PREFERRED EMBODIMENTS

Figure 1:
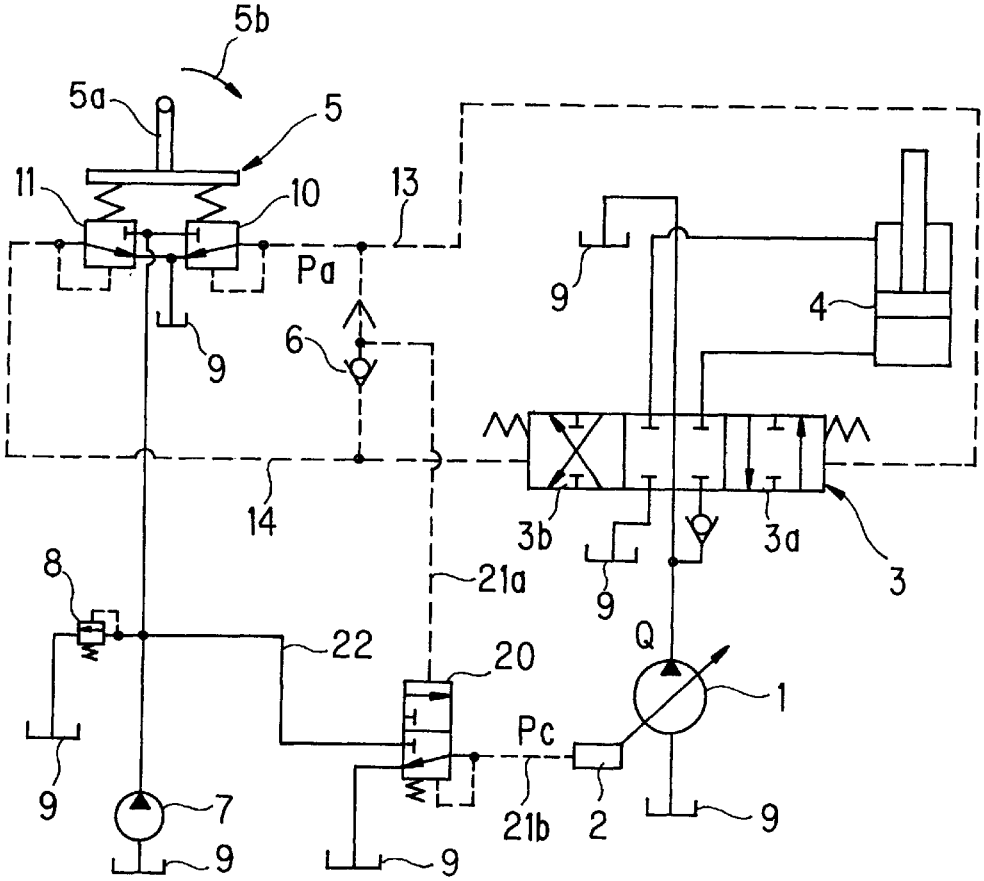
FIG. 1 is a hydraulic circuit diagram showing a first embodiment of a hydraulic control system according to the present invention for a construction machine.
Figure 2:
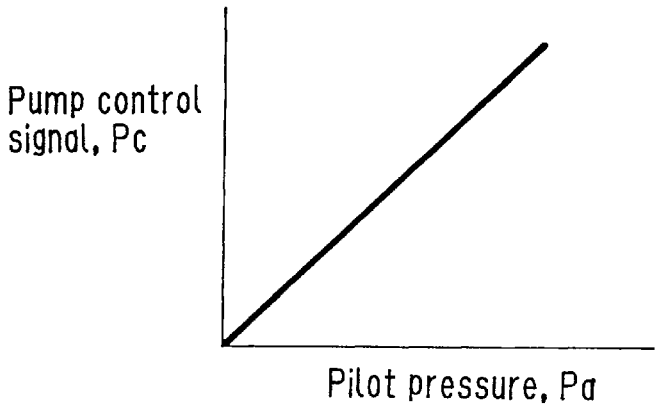
FIG. 2 is a diagram illustrating drive characteristics of a pressure-reducing valve arranged in the first embodiment shown in FIG. 1.
Figure 7:
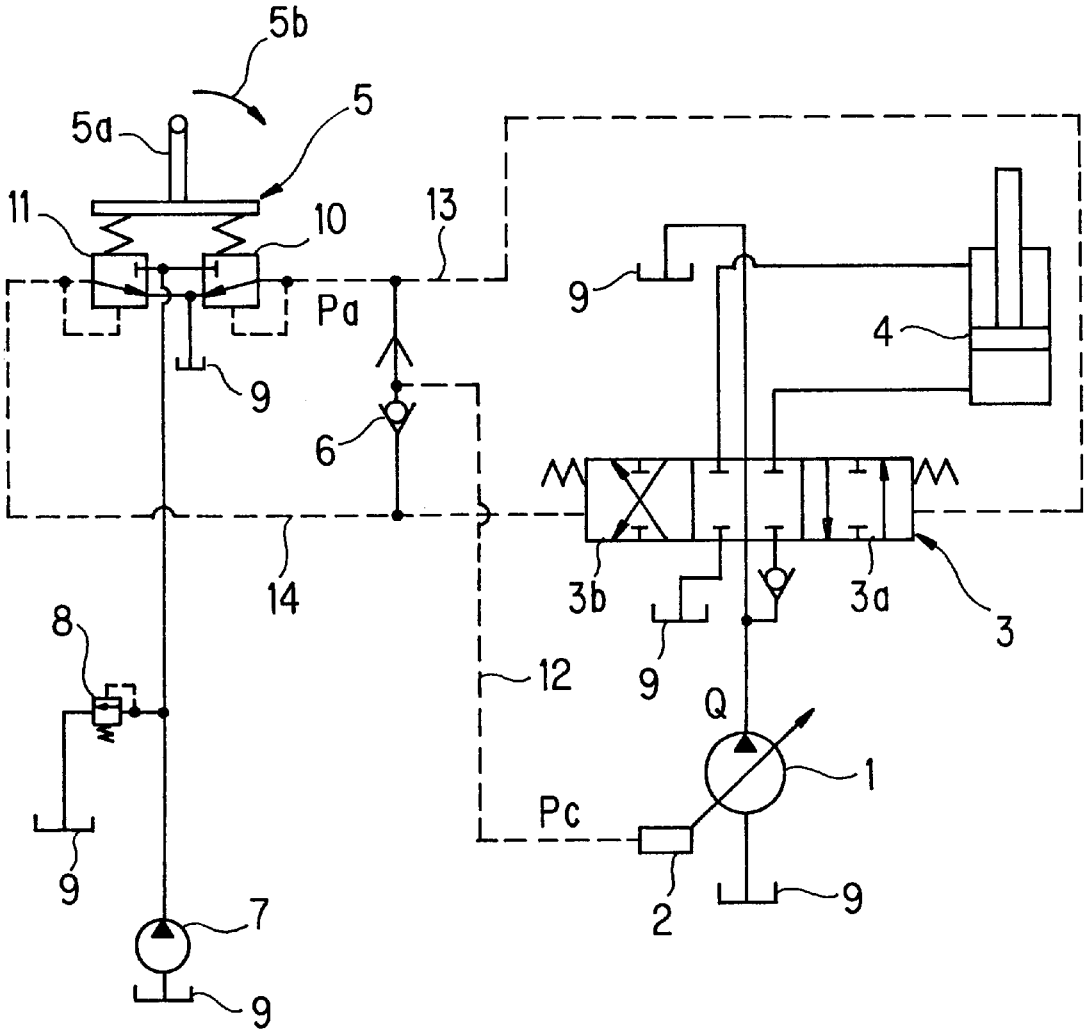
FIG. 7 PRIOR ART
FIG. 7 is a circuit diagram illustrating a conventional hydraulic control system for a construction machine.

Referring first to FIGS. 1 and 2, the first embodiment of the present invention will be described. The hydraulic control system according to the first embodiment depicted in FIG. 1 has been incorporated, for example, in a hydraulic excavator. In FIG. 1, elements of structure similar to those shown in FIG. 7 are identified by like reference numerals.

The hydraulic control system according to the first embodiment shown in FIG. 1 is also provided with the variable displacement hydraulic pump 1 making up the main pump, the actuator driven by pressure fluid delivered from the variable displacement hydraulic pump 1, for example, the hydraulic cylinder 4 such as an arm cylinder or boom cylinder, and the directional control valve 3 for controlling a flow of the pressure fluid to be fed from the variable displacement hydraulic pump 1 to the hydraulic cylinder 4. Incidentally, FIG. 1 illustrates only one hydraulic cylinder 4 and only one directional control valve 3. It is to be noted that, in an actual hydraulic excavators plural actuators such as other hydraulic cylinders and hydraulic motors and a like plural number of directional control valves are arranged. For the sake of facilitation of the description, these other actuators and their corresponding directional control valves are however omitted in both the drawings and the specification.

When the above-described directional control valve 3 is switched to the position 3*a*, the hydraulic cylinder 4 is brought, at the bottom side thereof, into communication with the variable displacement hydraulic pump 1 and is also brought, at the rod side thereof into communication with the tank 9. When the directional control valve 3 is switched to the position 3*b*, on the other hand, the hydraulic cylinder 4 is brought, at the rod side thereof, into communication with the variable displacement hydraulic pump 1 and is also brought, at the bottom side thereof, into communication with the tank 9. Their functions are similar to those mentioned above in connection with FIG. 7.

The hydraulic control system is also equipped with the flow control unit 2 for controlling the delivery rate of the variable displacement hydraulic pump 1, the pilot control valve 5 for outputting a pilot pressure Pa adapted to switch the directional control valve 3, the pilot pump 7 for feeding pressure fluid to the pilot control valve 5, and the pilot relief valve 8 for setting the delivery pressure of the pilot pump 7. As has been described above, the pilot control valve 5 includes the pressure-reducing valve portions 10, 11 and the control lever 5*a* for operating these pressure-reducing valve portions 10, 11. The pressure-reducing valve portion 10 is connected to one of the drive control units of the directional control valve 3 via the pilot line 13, whereas the pressure-reducing valve portion 11 is connected to the other drive control unit of the directional control valve 3 via the pilot line 14. The hydraulic control system is also equipped with the selector valve 6, which selects and outputs one of a greater value out of the pilot pressure Pa in the pilot line 13 and the pilot pressure Pa in the pilot line 14. The above basic construction is similar to that of the hydraulic control system shown in FIG. 7.

The first embodiment illustrated in FIG. 1 is provided especially with a first signal line 21*a* for guiding the above pilot pressure Pa selected by the selector valve 6, a pressure control valve for converting a delivery pressure of the pilot pump 7 to a pump control signal Pc, which is adapted to control driving of the flow control unit 2, in accordance with the pilot pressure Pa guided through the first signal line 21*a*, for example, a pressure-reducing valve 20 for setting the pump control signal Pc at a tank pressure when the pressure-reducing valve 20 is at its central position, a branch line 22 connecting the pilot pump 7 and the pressure-reducing valve 20 with each other, and a second signal line 21*b* for guiding the pump control signal Pc, which has been converted at the pressure-reducing valve 20, to the flow control unit 2.

The above-mentioned pressure-reducing valve 20 can be arranged almost independently from the position of the flow control unit 2 arranged in the vicinity of the variable displacement hydraulic pump 1. In other words, the pressure-reducing valve 20 can be arranged at a position adjacent to the selector valve 6. As a consequence, the first signal line 21 for guiding the pilot pressure Pa, which has been fed to the selector valve 6, as a pressure signal for driving the pressure-reducing valve 20 can be arranged as one having a substantially shortened length. For example, this first signal line 21*a* can be arranged as a steel tube as short as about several tens of centimeters or so. This makes it possible to make the total volume of the volume of the first signal line 21*a* and the volumes of the pilot lines 13, 14, which are connected to the respective drive control units of the directional control valve 3, relatively small, that is, smaller compared with the total volume of the corresponding lines shown in FIG. 7. Further, the second signal line 21*b* which connects the pressure-reducing valve 20 and the flow control unit 2 with each other can be arranged, for example, as a rubber hose of about several meters in length.

In the first embodiment constructed as described above, turning of the control lever 5*a* of the pilot control valve 5 over a stroke S in the direction of arrow 5*b*, for example, to make the hydraulic cylinder 4 perform an extending operation actuates the pressure-reducing valve 10, and a pilot pressure Pa is outputted from the pressure-reducing valve portion 10. This pilot pressure Pa is applied to the one drive control unit of the directional control valve 3 via the pilot line 13 so that the directional control valve 3 is switched to the position 3*a*.

Figure 8:
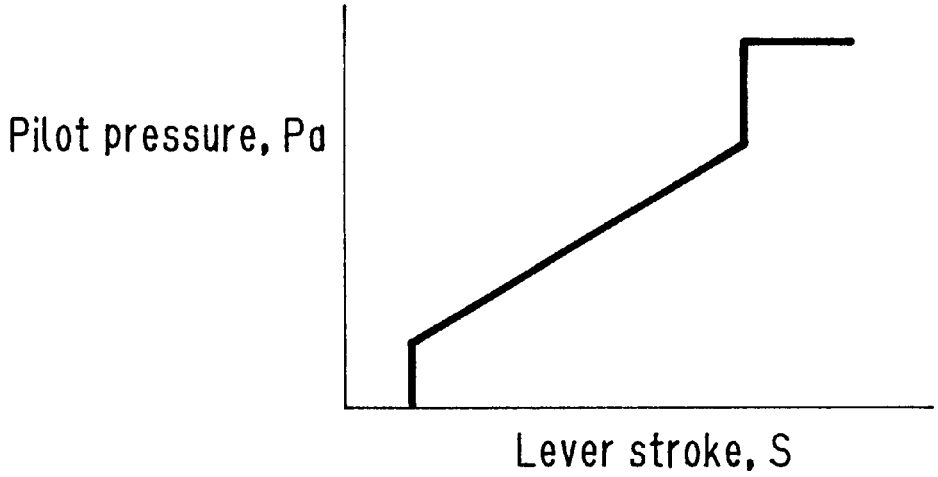
FIG. 8 PRIOR ART
FIG. 8 is a diagram showing output characteristics of a pilot control valve arranged in the hydraulic control system depicted in FIG. 7.
Figure 9:
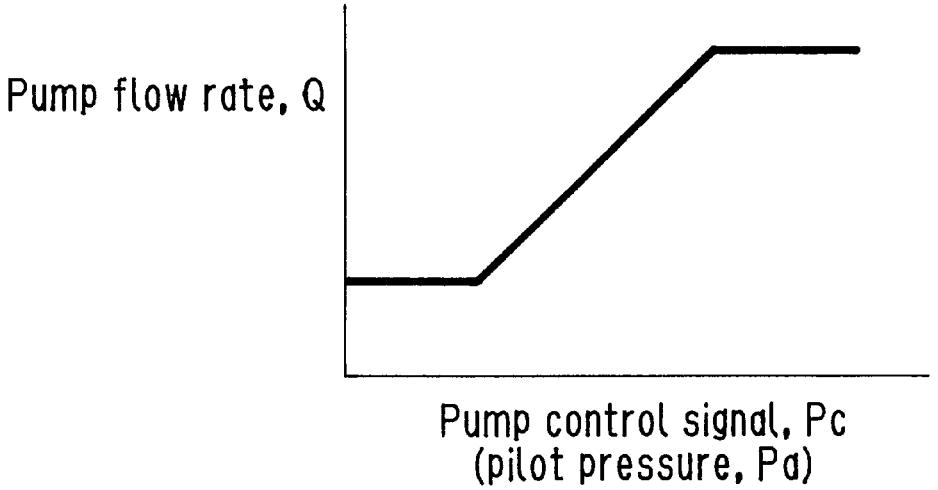
FIG. 9 PRIOR ART
FIG. 9 is a diagram depicting delivery rate characteristics of a variable displacement hydraulic pump arranged in the hydraulic control system shown in FIG. 7.

At this time, the pilot pressure Pa in the pilot line 13 is selected by the selector valve 6, and this pilot pressure Pa is guided through the first signal line 21*a* and the pressure-reducing valve 20 is operated. Accordingly, the pressure fluid which has been outputted from the pilot pump 7 and guided through the branch pipe 22 is converted to a pump control signal Pc at the pressure-reducing valve 20. This pump control signal Pc is outputted to the flow control unit 2 through the second signal line 21*b*. As a consequence, the flow control unit 2 is driven, and the pump flow rate Q of the pressure fluid delivered from the variable displacement hydraulic pump 1 is controlled so that it becomes substantially equal to the lever stroke S of the pilot control valve 5. Namely, a pilot pressure Pa which is substantially in proportion with the lever stroke S of the pilot control valve 5 is outputted for the above-mentioned relationship shown in FIG. 8. As is illustrated in FIG. 2, a pump control signal Pc which is proportional with the pilot pressure Pa is outputted to the flow control unit 2, whereby the pump flow rate Q outputted from the variable displacement hydraulic pump 1 is controlled. The pressure fluid delivered at the pump flow rate Q from the variable displacement hydraulic pump 1 is fed to the bottom side of the hydraulic cylinder 4 via the above-mentioned position 3*a* of the directional control valve 3, and the fluid on the rod side is returned to the tank 9 via the position 3*a* of the directional control valve 3. As a consequence the hydraulic cylinder 4 performs an extending operation so that the associated working equipment of the unillustrated hydraulic excavator.

Incidentally, when the pilot control valve 5 is not operated and the pressure-reducing valve 20 remains at its center position as shown in FIG. 1, the flow control unit 2 is in communication with the tank 9 via the second signal line 21*b* so that the flow control unit 2 sets the pump flow rate Q of the variable displacement hydraulic pump 1 at a predetermined minimum flow rate. Namely, the pressure fluid is delivered at the predetermined flow rate from the variable displacement hydraulic pump 1 at this time. For example, this minimum flow rate can be set at 0.

In the above-described first embodiment, the pressure-reducing valve 20 is arranged in the vicinity of the selector valve 6 and the first signal line 21 has a short length. Accordingly, the total volume of the first signal line 21*a* and the pilot lines 13, 14 is relatively small. As a consequence, upon operation of the pilot control valve 5, the resulting pilot pressure Pa is instantaneously applied to one of the drive control units of the directional control valve 3 so that the directional control valve 3 is switched. Namely, the directional control valve is switched over a stroke corresponding to the stroke of the pilot control valve 5, and the directional control valve 3 exhibits good switching responsibility to the operation of the pilot control valve 5.

Further, when the pilot control valve 5 is operated as mentioned above, the pressure-reducing valve 20 is actuated by the resulting pilot pressure Pa so that the pressure fluid outputted from the pilot pump 7 is converted to a pump control signal Pc at the pressure-reducing valve 20. A sufficient flow rate can be assured for the pump control signal Pc, which has been obtained as described above by converting the flow rate and pressure of the pressure fluid outputted from the pilot pump 7, independently from the volumes of the pilot lines 13, 14 which connect the pilot control valve 5 and the respective drive control units of the directional control valve 3 with each other. As a consequence, the flow control unit 2 is driven instantaneously when the pressure-reducing valve is driven, whereby good follow-up controllability of an increase or decrease in the pump flow rate of the variable displacement hydraulic pump 1 can therefore be obtained for the operation of the pilot control valve 5.

According to the first embodiment, it is therefore possible to achieve good matching among the operation of the pilot control valve 5, the switching operation of the directional control valve 3 and the control of the pump flow rate Q of the variable displacement hydraulic pump 1. The driving of the hydraulic cylinder 4 which is controlled by the directional control valve 3 can therefore be controlled with high accuracy, thereby making it possible to improve the efficiency of work performed by the hydraulic excavator.

Figure 3:
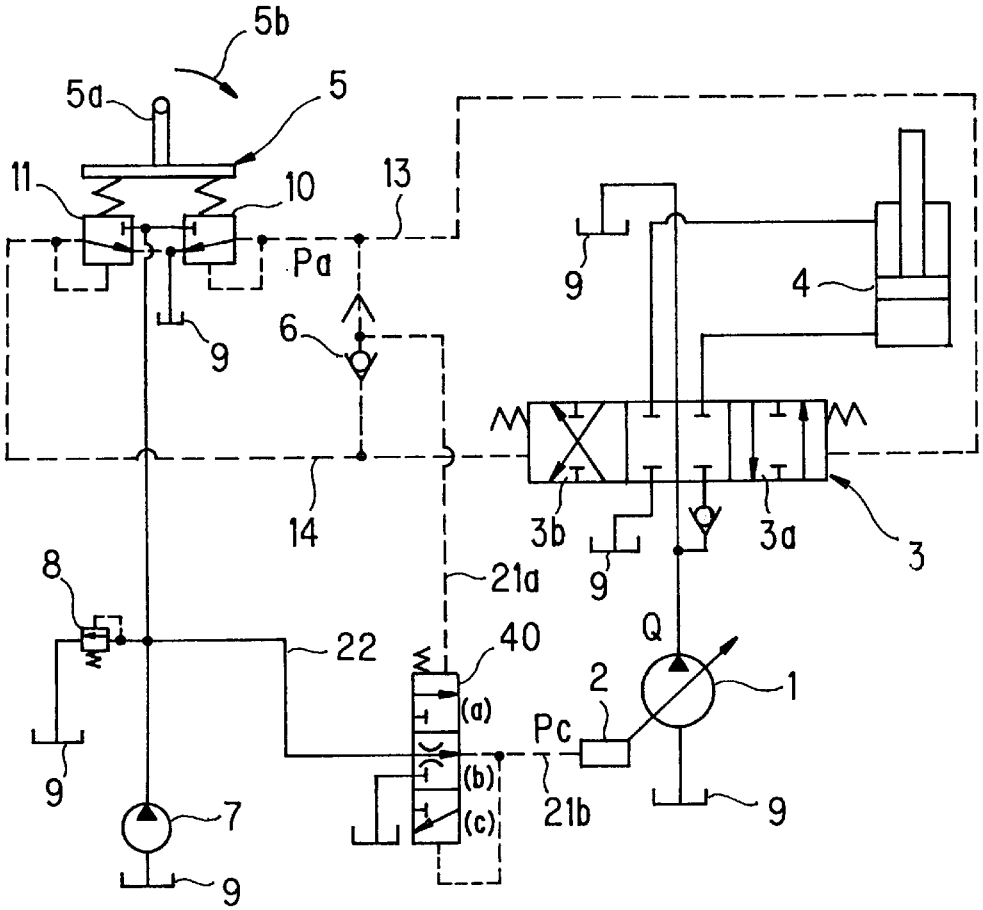
FIG. 3 is a hydraulic circuit diagram illustrating a second embodiment of the present invention.
Figure 4:
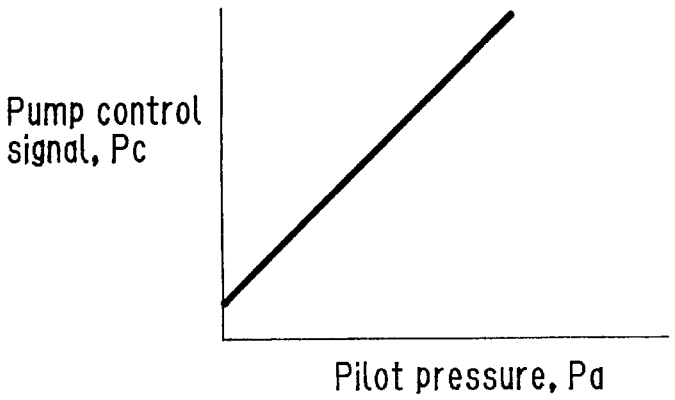
FIG. 4 is a diagram depicting drive characteristics of a pressure-reducing valve arranged in the second embodiment shown in FIG. 3.

Referring next to FIG. 3 and FIG. 4, the second embodiment of the present invention will be described.

In the second embodiment, a pressure-reducing valve 40 is arranged as a pressure control valve for converting a delivery pressure of the pilot pump 7 to a pump control signal Pc, which is adapted to control driving of the flow control unit 2, in accordance with a pilot pressure guided by the first signal line 21*a*. This pressure-reducing valve 40 sets the pump control signal Pc at a predetermined pressure higher than a tank pressure when it is at its center position is arranged. Described specifically, the pressure-reducing valve 40 is set so that, when it is at its center position, it is offset to an extent corresponding to the force of a spring to assume a restrictor position (b). The remaining construction is the same as that of the above-described first embodiment shown in FIG. 1.

This second embodiment can bring about similar advantageous effects as the above-described first embodiment. In particular, even when the pilot control valve 5 is not operated and the pressure-reducing valve 40 retains at its center position, a portion of pressure fluid delivered from the pilot pump 7 and guided through the branch line 22 is converted at the pressure-reducing valve 40 and is then fed as a pump control signal Pc to the signal line 21*b* (as shown by way of example in FIG. 4). As a result, the flow control unit 2 is slightly driven so that the pump flow rate Q of the variable displacement hydraulic pump 1 is set at a predetermined flow rate greater than a predetermined minimum flow rate. Even in a stopped state of a work vehicle that the pilot control valve 5 remains non-operated, the pressure fluid is allowed to flow at the predetermined flow rate through the hydraulic circuit, thereby making it possible to prevent cooling of the circuit, that is, to achieve warming-up. Further, it is also possible to deliver the pressure fluid at a relatively large flow rate Q from the variable displacement hydraulic pump 1 from the time of an initiation of operation of the pilot control valve 5. This makes it possible to shorten the rise time of the hydraulic cylinder 4 upon starting work and hence to improve the efficiency of the work performed by the hydraulic excavator.

Figure 5:
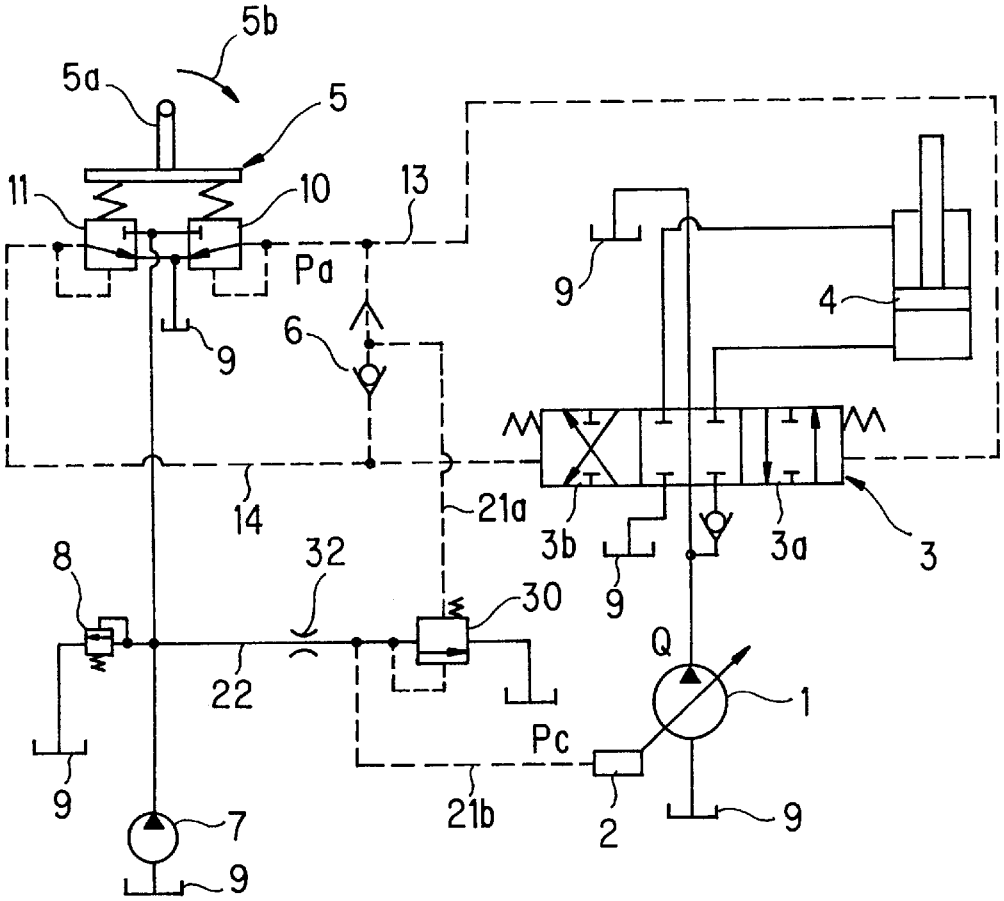
FIG. 5 is a hydraulic circuit diagram showing a third embodiment of the present invention.
Figure 6:
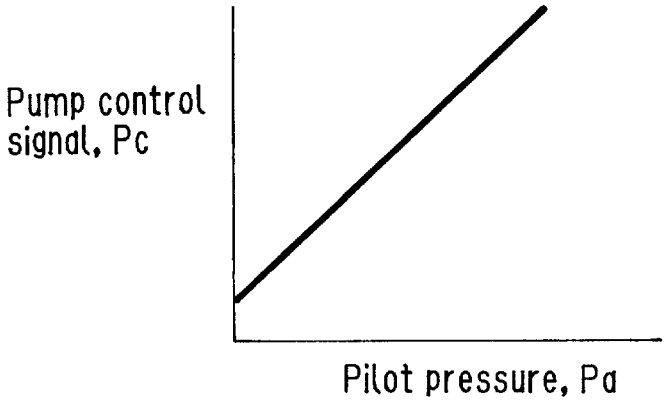
FIG. 6 is a diagram showing drive characteristics associated with a relief valve disposed in the third embodiment illustrated in FIG. 5.

Further, the third embodiment of the present invention will be described with reference to FIG. 5 and FIG. 6.

In the third embodiment, a relief valve 30 is arranged as a pressure control valve for converting a delivery pressure of the pilot pump 7 to a pump control signal Pc, which is adapted to control driving of the flow control unit 2, in accordance with a pilot pressure Pa guided through the first signal line 21*a*. For example, even when the pilot control valve 5 is not operated and remains at is center position, a suitable adjustment of a preset force of a spring allows the relief valve 30 to prevent a predetermined amount of the pressure fluid, which flows through the branch line 22, from flowing out to the tank 9 without returning the pressure fluid in its entirety to the tank 9. The third embodiment is designed to output the pump control signal Pc from the branch line 22 at a position between the restrictor 32 and the relief valve 30. The remaining construction is the same as that of the above-described first embodiment shown in FIG. 1.

In the third embodiment constructed as described above, a pilot pressure Pa is fed to the selector valve 6 when the lever 5*a* of the pilot control valve 5 is operated over a desired stroke S. This pilot pressure Pa is guided through the signal line 21*a* to actuate the relief valve 30. The pressure fluid, which has been delivered from the pilot pump 7 and has passed through the restrictor 32, is then converted to a pump control signal Pc in the branch line 22 at the position between the restrictor 32 and the relief valve 30, and the pump control signal PC is applied to the flow control unit 2. As a consequence, the pump flow rate Q of the variable displacement hydraulic pump 1 is controlled at a flow rate which corresponds to the lever stroke S of the pilot control valve 5.

In a state that the pilot control valve 5 is not operated and the relief valve 30 remains at its center position, on the other hand, a predetermined portion of the pressure fluid delivered from the pilot pump 7 is prevented from flowing out to the tank 9 as described above. Accordingly, a pressure is developed in the branch line 22 at the position between the restrictor 32 and the relief valve 30 so that, as is illustrated in FIG. 6, a pump control signal Pc higher than a tank pressure is outputted to the signal line 21*b* although the pump control signal Pc has a small value. As a result, the delivery rate Q of the variable displacement hydraulic pump 1 is set at a predetermined flow rate greater than a predetermined minimum flow rate as in the above-described second embodiment. The third embodiment can therefore bring about similar advantageous effects as the second embodiment, that is, can achieve warming-up in a stopped state of the hydraulic excavator and, owing to assurance of a short rise time of the hydraulic cylinder 4 at the time of an initiation of work by the hydraulic excavator, can also improve the efficiency of the work performed by the hydraulic excavator.

In the above description, the force of the spring of the relief valve 30 is preset at such a level that, even when the pilot control valve 5 is not operated and remains at its center position, the pressure fluid, which is flowing through the branch line 22, is not returned in its entirety to the tank 9 and a predetermined portion of the pressure fluid is prevented from flowing out to the tank 9. Instead of this, the force of the spring of the relief valve 30 may be set at such a level that the pressure fluid flowing through the branch line 22 is returned in its entirety to the tank 9 when the pilot control valve 5 is not operated and remains at its center position. In other words, it is possible to arrange a relief valve which sets the pump control signal Pc at the tank pressure when the pilot control valve 5 is not operated and remains at its center position. This construction can bring about substantially the same advantageous effects as the above-described first embodiment.

As has been described above, the present invention can bring about various advantageous effects. According to the present invention, the length of the first signal line which guides a pilot pressure adapted to drive the pressure control valve can be made short, thereby making it possible to reduce the total volume of the first signal line and the pilot lines connected to the directional control valve compared with the conventional art. Sufficient pressure fluid can therefore be instantaneously fed to one of the pilot lines as a result of operation of the pilot control valve, whereby the switching responsibility of the directional control valve to the operation of the pilot control valve can be improved over that available from the conventional art. In addition, the pump control signal, which can be obtained by converting at the pressure control valve the pressure fluid outputted from the pilot pump, is absolutely irrelevant to the volumes of the pilot lines connected to the directional control valve and is hence assured to have a sufficient flow rate. This makes it possible to improve the follow-up controllability of an increase or decrease in the pump flow rate of the variable displacement hydraulic pump for the operation of the pilot control valve over that available from the conventional art. From these advantageous effects, it is possible to achieve good matching among the operation of the pilot control valve, the switching operation of the directional control valve and the control of the pump flow rate of the variable displacement hydraulic pump. The driving of the hydraulic cylinder which is controlled by the directional control valve can therefore be controlled with high accuracy, thereby making it possible to improve the efficiency of work performed by the hydraulic excavator.

Especially when the pressure-reducing valve in the second embodiment or the relief valve in the third embodiment is one capable of setting the above-described pump control signal at the predetermined pressure higher than the tank pressure, the pressure fluid is allowed to flow at the predetermined flow rate through the hydraulic circuit. This makes it possible to achieve warming-up. It is also possible to deliver the pressure fluid at a relatively large flow rate from the variable displacement hydraulic pump even from the time of an initiation of operation of the pilot control valve. As a consequence, the rise time of the actuator at the time of an initiation of work by the hydraulic excavator can be shortened. This makes it possible to improve the efficiency of the work performed by the hydraulic excavator.

What is claimed is:

1. A hydraulic control system for a construction machine provided with a variable displacement hydraulic pump, an actuator driven by pressure fluid delivered from said variable displacement hydraulic pump, a directional control valve for controlling a flow of said pressure fluid delivered from said variable displacement hydraulic pump and to be fed to said actuator, a pilot control valve capable of outputting plural pilot pressures for switching said directional control valve, a pilot pump for feeding pressure fluid to said pilot control valve, a selector valve for selecting one of a maximum value out of said plural pilot pressures outputted from said pilot control valve, and a flow control unit for controlling a delivery rate of said variable displacement hydraulic pump on a basis of said pilot pressure selected by said selector valve, wherein said hydraulic control system comprises:

a first signal line for guiding said pilot pressure selected by said selector valve;

a pressure control valve for converting a delivery pressure of said pilot pump to a pump control signal, which serves to control driving of said flow control unit, in accordance with said pilot pressure guided through said first signal line;

a branch line for connecting said pilot pump and said pressure control valve with each other; and a second signal line for guiding said pump control signal, which has been converted by said pressure control valve, to said flow control unit.

2. The hydraulic control system according to claim 1, wherein said pressure control valve is a pressure-reducing valve.

3. The hydraulic control system according to claim 2, wherein said pressure-reducing valve is a pressure-reducing valve for setting said pump control signal at a tank pressure when said pressure-reducing valve is at a center position.

4. The hydraulic control system according to claim 2, wherein said pressure-reducing valve is a pressure-reducing valve for setting said pump control signal at a predetermined pressure higher than a tank pressure when said pressure-reducing valve is at a center position.

5. The hydraulic control system according to claim 1, wherein said pressure control valve is a relief valve, a restrictor is arranged in said branch line, and said pump control signal is outputted from said branch line at a position between said restrictor and said relief valve.

6. The hydraulic control system according to claim 5, wherein said relief valve is a relief valve for setting said pump control signal at a tank pressure when said relief valve is at a center position.

7. The hydraulic control system according to claim 5, wherein said relief valve is a relief valve for setting said pump control signal at a predetermined pressure higher than a tank pressure when said relief valve is at a center position.

* * * * *